US010082292B1

(12) United States Patent
Miller et al.

(10) Patent No.: US 10,082,292 B1
(45) Date of Patent: Sep. 25, 2018

(54) ADVANCED LEAN BURN INJECTOR IGNITER SYSTEM

(71) Applicant: Florida Turbine Technologies, Inc., Jupiter, FL (US)

(72) Inventors: Timothy J Miller, Jupiter, FL (US); Paul G Hicks, Jupiter, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 0 days.

(21) Appl. No.: 15/704,683

(22) Filed: Sep. 14, 2017

Related U.S. Application Data

(62) Division of application No. 14/614,215, filed on Feb. 4, 2015, now Pat. No. 9,822,977.

(60) Provisional application No. 61/935,649, filed on Feb. 4, 2014.

(51) Int. Cl.

| | |
|---|---|
| ***F02F 3/28*** | (2006.01) |
| ***F02P 23/00*** | (2006.01) |
| ***F23Q 1/02*** | (2006.01) |

(52) U.S. Cl.
CPC ..... *F23Q 1/02* (2013.01); *F02F 3/28* (2013.01); *F02P 23/00* (2013.01)

(58) Field of Classification Search
CPC ..... F23Q 1/02; F02P 23/00; F02F 3/26; F02F 3/28; F02F 3/285
USPC .... 123/269, 279, 285, 280, 298, 143 B, 525
See application file for complete search history.

(56) References Cited

U.S. PATENT DOCUMENTS 4,446,826 A * 5/1984 Kimura ..... F02P 23/045 123/143 B

FOREIGN PATENT DOCUMENTS

EP 0937890 * 2/1999 ..... F02F 3/26

* cited by examiner

*Primary Examiner* — Hai Huynh
(74) *Attorney, Agent, or Firm* — John Ryznic

(57) ABSTRACT

An internal combustion engine with a piston having a piston head with a resonance cavity opening onto the head, and where a fuel nozzle located in a cylinder head is positioned to inject a fuel such as natural gas into the combustion chamber where resonance formed within the resonance cavity will ignite the fuel without the need of a spark plug. Inlet and exhaust ports in the cylinder head allow for air and combustion gas enter or leave the combustion chamber.

4 Claims, 2 Drawing Sheets

ADVANCED LEAN BURN INJECTOR IGNITER SYSTEM

CROSS-REFERENCE TO RELATED APPLICATIONS

This application is a DIVISIONAL Application of U.S. patent application Ser. No. 14/614,215 filed on Feb. 4, 2015 and entitled ADVANCED LEAN BURN INJECTOR IGNITER SYSTEM; which claims the benefit to U.S. Provisional Application 61/935,649 filed on Feb. 4, 2014 and entitled ADVANCED LEAN BURN INJECTOR IGNITER SYSTEM.

GOVERNMENT LICENSE RIGHTS

None.

BACKGROUND OF THE INVENTION

Field of the Invention

The present invention relates generally to an internal combustion engine, and more specifically to an internal combustion engine with self-ignition.

Description of the Related Art Including Information Disclosed Under 37 CFR 1.97 and 1.98

An internal combustion engine, such as one that powers an automobile, includes a combustion chamber with a reciprocating piston that compresses a gas and a spark plug that ignites the compressed gas a fuel mixture to produce combustion. A diesel engine does not make use of a spark plug, but uses the high pressure compressed air to auto-ignite a diesel fuel that is injected into the combustion chamber at near top-dead-center of the piston. A diesel engine cannot burn natural gas because the auto-ignition temperature of natural gas is much higher than the temperature produced in the gas from the compression. For this reason, a diesel engine would also inject a fuel such as diesel fuel into the compressed natural gas to ignite the compressed natural gas to produce combustion.

As pressures increase in an internal combustion engine to produce higher efficient engines, the temperature of the compressed gas also increases. Too high of a pressure results in to high of a temperature, and the compressed gas would ignite prematurely.

High thermal efficiency and reduced emissions, such as NOx, in a reciprocating internal combustion (IC) engine can be achieved by reducing the fuel/air ratio and increasing the break mean effective pressure. However, traditional ignition methods become unreliable as the mixture ratio becomes to lean, leading to higher coefficient of variation (COV) and spark plugs tend to fail via flash-over caused by the higher voltages required by the higher ignition pressure. These high voltages also reduce spark plug life due to higher erosion rates. As a result, elimination of the spark plug with a more reliable ignition method could improve emissions and enable efficiency gains to be realized with leaner mixtures and higher combustion pressures.

Also, spark plugs need to be replaced at regular intervals due to wear. This generally occurs during regularly scheduled maintenance, not necessarily when the spark plugs actually need to be replaced. When done this way, unforeseen shutdowns due to failures between scheduled maintenance intervals may occur. Therefore, eliminating the need for spark plugs will also reduce maintenance costs and engine down-time.

U.S. Pat. No. 4,969,425 issued to Slee on Nov. 13, 1990 and entitled PISTON WITH A RESONANT CAVITY discloses an internal combustion engine with a resonance cavity formed in the piston of to a side toward an exhaust port of the engine, and where the engine includes a spark plug to ignite the fuel and air mixture.

BRIEF SUMMARY OF THE INVENTION

The present invention is an internal combustion engine with self-ignition, where the fuel can be a liquid fuel or a gaseous fuel. Resonance tube ignition, where a specially designed cavity in the head of a piston combined with high pressure gas injection is used to induce shock waves which in-turn raises the local fuel/air mixture temperature above ignition. This process is very reliable and does not require a spark plug.

In order to ignite a mixture of fuel and air, the temperature must be raised and the air/fuel ratio must be such that the mixture ignites. In a spark-ignition engine, the temperature rise is provided with a localized electrical energy discharge, whereas in a compression ignition (such as diesel) engine the entire air/fuel mixture rises in temperature due to mechanical compression of the gas and the heat of the cylinder wall. Resonance tube ignition occurs because of a rapid localized increase in temperature caused by a sudden increase in pressure from compression waves emanating from the nozzle that is injecting gas into a resonance tube within the combustion chamber cavity at sonic velocities and resonating in the cavity.

DETAILED DESCRIPTION OF THE INVENTION

The present invention is an internal combustion engine with self-ignition, where the fuel can be a liquid fuel or a gaseous fuel. Resonance tube ignition, where a specially designed cavity combined with high pressure gas injection is used to induce shock waves which in-turn raises the local fuel/air mixture temperature above ignition. This process is very reliable and does not require a spark plug.

In order to ignite a mixture of fuel and air, the temperature must be raised and the air/fuel ratio must be such that the mixture ignites. In a spark-ignition engine, the temperature rise is provided with a localized electrical energy discharge, whereas in a compression ignition (such as diesel) engine the entire air/fuel mixture rises in temperature due to mechanical compression of the gas and the heat of the cylinder wall. Resonance tube ignition occurs because of a rapid localized increase in temperature caused by a sudden increase in pressure from compression waves emanating from the nozzle that is injecting gas into a resonance tube within the combustion chamber cavity at sonic velocities and resonating in the cavity.

Figure 1:
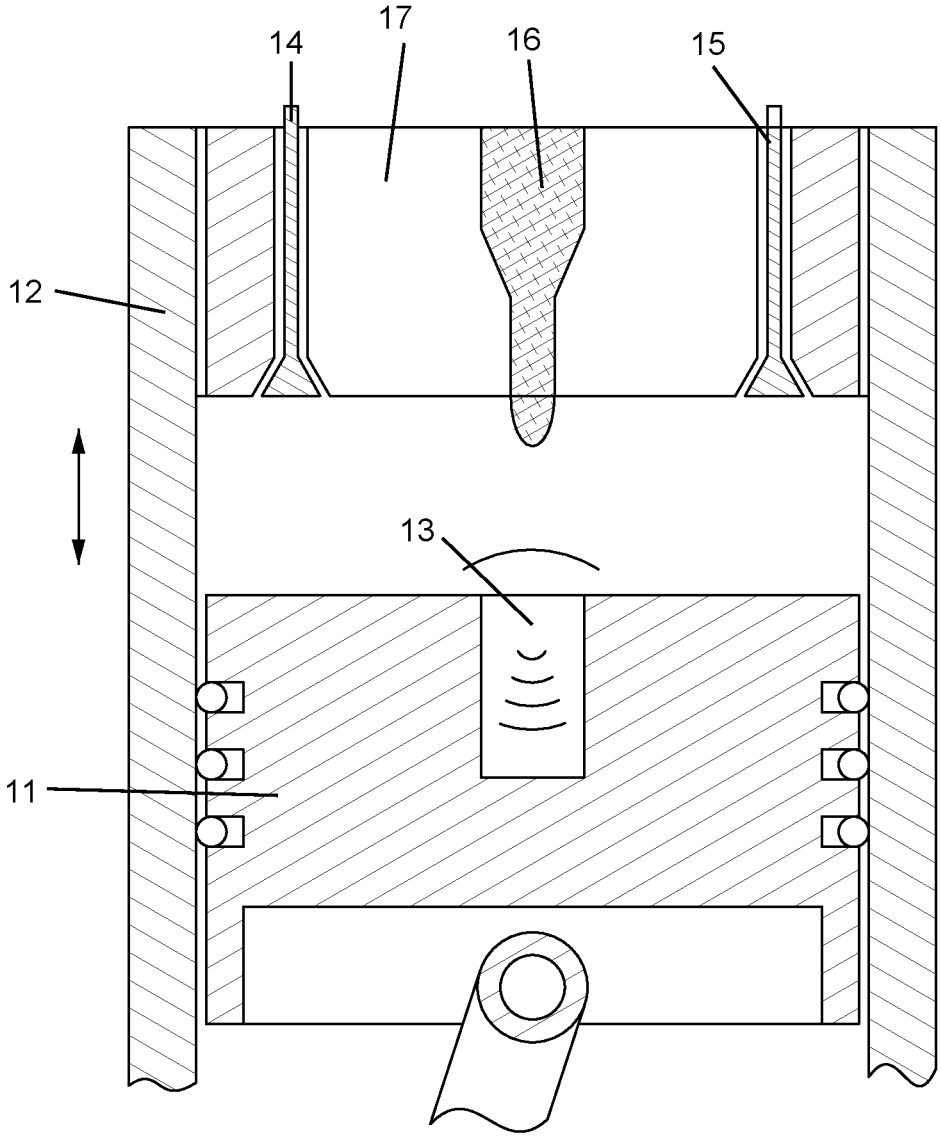
FIG. 1 shows a cross section view of a reciprocating piston within a cylinder with a resonance cavity and injection nozzle of the present invention for auto-ignition.

FIG. 1 shows a combustion chamber of the present invention with a piston 11 reciprocating within a cylinder 12. The piston includes a piston head with a resonance cavity 13 that creates shock waves. The resonance cavity has a cavity width (w) and a cavity length (I). The combustion chamber is formed between the piston head and a cylinder head that includes an inlet valve 14 and an exhaust valve 15 as well as a nozzle 16 that opens into the combustion chamber.

Air can be drawn into the combustion chamber through the inlet valve 14 while the exhaust gas from combustion can be discharged through the exhaust valve 15. A fuel such as natural gas can be injected into the combustion chamber through the nozzle 16. The gaseous fuel (or even air) can be injected into the resonance cavity 13 that will bounce off of the cavity floor and flow back toward the injection nozzle 16 as a bow wave (represented by the concave curve in FIG. 1 above the resonance cavity). Shock waves are formed from the bow waves striking the oncoming waves from the injector nozzle 16 that produce patterns of high pressure that result in high temperature. An injection of gaseous oxygen and gaseous hydrogen at 70 degrees F. will produce a heated gas in excess of 1,000 degrees F. which would be high enough temperature to auto-ignite the gas mixture and produce combustion within the combustion chamber.

As the piston 11 moves up and down within the cylinder 12, the spacing or distance between the nozzle 16 and the opening of the resonance cavity 13 (nozzle-cavity gap) will change. One desirable feature of the present invention is that combustion should occur at or near to the top-dead-center (TDC) of the piston within the chamber. Thus, the nozzle-cavity gap will be near to the minimum when the piston 11 is at or near to the top-dead-center when the auto ignition is desirable. With the auto-ignition device of the present invention, much leaner bulk mixtures and higher pressures can be achieved than in the spark ignited engines of the prior art. The cavity width and the cavity length can be designed such that the auto-ignition temperature will only occur at the desired location of the piston within the cylinder such as at TDC.

The engine in FIG. 1 can inject a fuel and air into the combustion chamber through the inlet valve 14 as in a typical ICE and inject compressed air through the nozzle 16 that would create the shock waves that induce an auto-ignition of the compressed fuel and air mixture. Thus, vaporized gasoline could be combusted with compressed air using the resonance cavity 13 that creates the shock waves to ignite the fuel/air mixture within a spark plug. In a diesel engine, the diesel fuel and the air can be injected through the inlet valve 14 and then compressed by the piston 11 moving upward in the cylinder 12, and compressed air can be injected through the nozzle 16 into the resonance cavity 13 to create the shock waves that produce the ignition of the fuel/air mixture. In either of these embodiments, a gaseous fuel such as natural gas can also be injected through the nozzle 16 to produce shock waves in the resonance cavity 13 to produce the combustion without using a spark plug.

Figure 2:
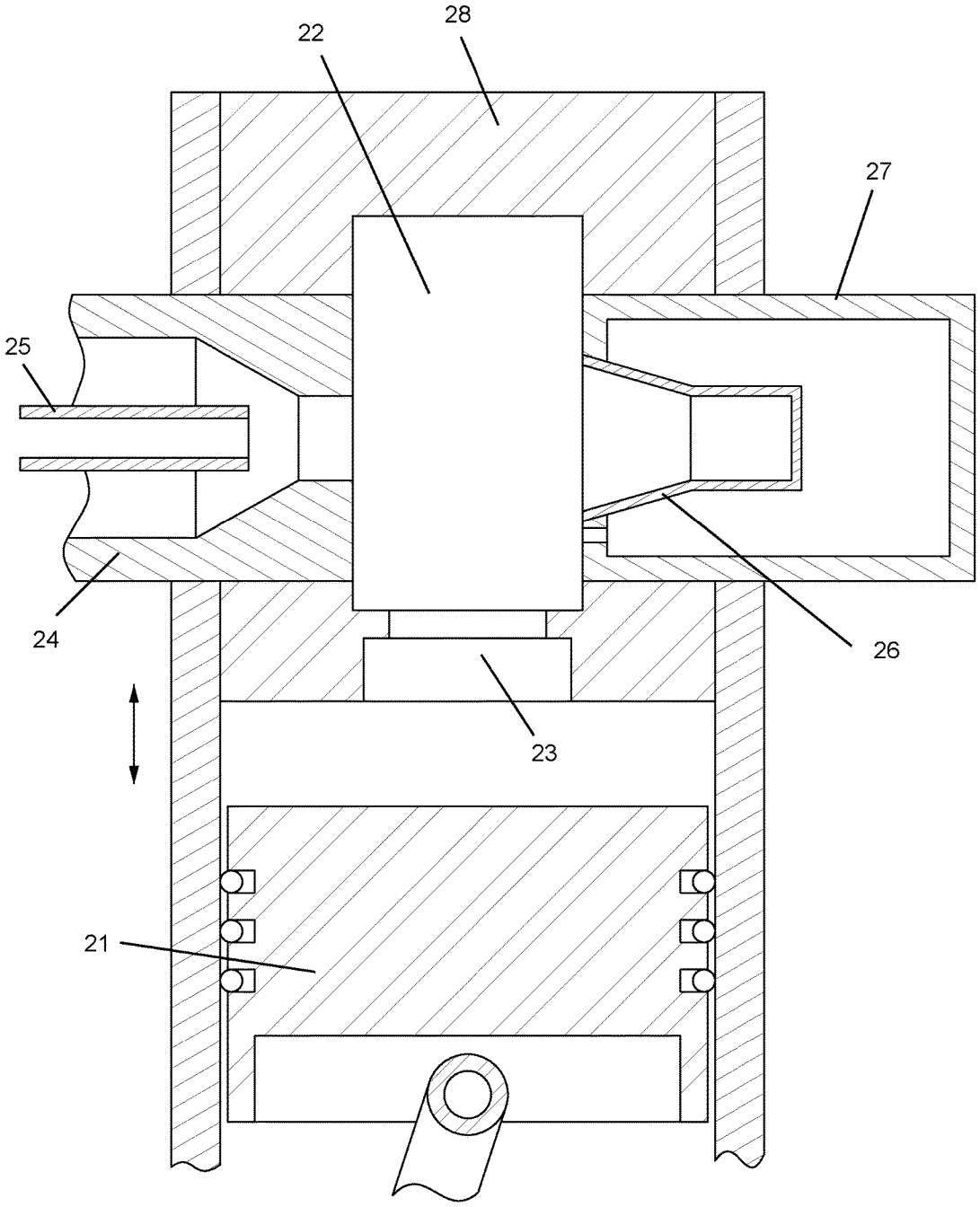
FIG. 2 shows a second embodiment of the present invention in which the resonance cavity is located in the cylinder head as a static part of the cylinder.

In another embodiment of the present invention, a resonance cavity can be formed on the cylinder head that would face toward a side of the cylinder where an injector nozzle would be located that would inject the compressed air or gas into the resonance cavity to produce the shock waves. Because the resonance cavity in this embodiment would not move and thus the nozzle-cavity gap would not change, the compressed air or gas would only be injected when the auto-ignition should occur such as when the piston is at TDC or nearby. FIG. 2 shows a cylinder head having the resonance cavity formed within along with fuel and air supply for the combustion chamber. U.S. Pat. No. 6,272,845 issued to Kassaev et al. on Aug. 14, 2001 and entitled ACOUSTIC IGNITER AND IGNITION METHOD FOR PROPELLANT LIQUID ROCKET ENGINE shows a piece than can be formed within the cylinder head of the engine to produce a similar effect at that disclosed in FIG. 1 embodiment. The FIG. 2 embodiment includes piston 21 with a typical flat head, a combustion chamber 22, an outlet orifice 23, an injection nozzle 24, a fuel injector tube 25, an acoustic resonator 26, a housing 27, and a cylindrical wall 28 among other structure as described in the Kassaev et al. patent.

In this embodiment, compressed air is provided from an external source to the combustion chamber at, or close to TDC via the injection nozzle 24. This compressed air travels across the combustion chamber 22, enters the acoustic resonator 26, which reflects back into the chamber creating a shock that increases the temperature in the combustion chamber 22. At the appropriate time in the cycle, fuel is introduced into the combustion chamber creating a combustible mixture which is then ignited by the shock created. This ignites the fuel/air mixture in the engine via orifice 23.

We claim the following:

1. A piston for an internal combustion engine in which the engine is without a spark plug, the piston comprising:

a piston head;

a resonance cavity opening onto the piston head; and, the resonance cavity having a shape to produce ignition of a fuel within the engine without a spark plug due to a resonance formed within the resonance cavity.

2. The piston of claim 1, and further comprising:

the resonance cavity is rectangular in a cross sectional side view.

3. The piston of claim 1, and further comprising:

the resonance cavity has a cavity length greater than the cavity width.

4. The internal combustion engine of claim 1, and further comprising:

the fuel is natural gas.

* * * * *